US005680089A

United States Patent [19]

Matsuoka

[11] Patent Number: 5,680,089

[45] Date of Patent: Oct. 21, 1997

[54] FUSE

[75] Inventor: Naoki Matsuoka, Shizuoka, Japan

[73] Assignee: Yazaki Corporation, Tokyo, Japan

[21] Appl. No.: 733,448

[22] Filed: Oct. 18, 1996

[30] Foreign Application Priority Data

Oct. 20, 1995 [JP] Japan ..... 7-272988

[51] Int. Cl.[6] ..... H01H 85/02; H01H 85/30; H01H 85/24; H01H 85/143

[52] U.S. Cl. ..... 337/198; 337/206; 337/262; 337/265; 337/268; 439/622

[58] Field of Search ..... 439/621, 622; 337/186, 190, 196, 198, 201, 206, 212, 255, 260, 265, 268

[56] References Cited

U.S. PATENT DOCUMENTS

| | | | |
|---|---|---|---|
| 4,224,592 | 9/1980 | Urani | 337/198 |
| 4,344,060 | 8/1982 | Ciesemier et al. | 337/260 |
| 4,349,804 | 9/1982 | Gaia | 337/198 |
| 4,604,602 | 8/1986 | Borzoni | 337/264 |
| 4,635,023 | 1/1987 | Oh | 337/163 |

*Primary Examiner*—Leo P. Picard
*Assistant Examiner*—Stephen T. Ryan
*Attorney, Agent, or Firm*—Sughrue, Mion, Zinn, Macpeak, and Seas

[57] ABSTRACT

A fuse in which molten metal can be positively held or retained in a housing when a fuse element melts, and the melting of the fuse element can be easily confirmed. The fuse includes the fuse element including opposite side portions respectively defining a pair of metal terminals which are connected together through an element having a fusible portion, and are disposed in a generally common plane, and a flap of a metal material which is bendable at the boundary between the flap and the element, an insulating member being formed on at least one face of the flap; and a housing including opposite side portions respectively defining a pair of terminal receiving portions for respectively receiving the pair of terminals, and a central portion defining an element receiving portion for receiving the element, the element receiving portion having an open portion at its upper side. When the flap is bent, that face of the flap having the insulating member formed thereon is exposed to the exterior.

9 Claims, 3 Drawing Sheets

FUSE

BACKGROUND OF THE INVENTION

1. Field of the Invention

This invention relates to a blade-type fuse, and more particularly to such a fuse in which the dissipation of molten metal is prevented when the fuse melts.

2. Background

Blade-type fuses have heretofore been used in many fields, as in automobiles. FIG. 4 is a perspective view showing a conventional blade-type fuse. A fuse element 5 includes a fusible body 3 which is provided between and is formed integrally with a pair of blade-shaped terminal portions 1 and 2. A flap-retaining pawl 4 is formed integrally with each of the terminal portions 1 and 2, and is disposed adjacent to the fusible body 3.

The fuse element 5 is housed in a housing 6. The housing 6 is molded of a transparent resin so that the fuse element 5 therein can be viewed with the eyes, and an opening is formed at a lower end portion of the housing 6 to receive the fuse element 5 into the housing 6.

A flap 7 is formed integrally and is extends downwardly from the lower end of the housing 6, and this flap 7 serves to prevent the molten metal from splashing to the exterior of the housing 6 when the fusible body 3 of the fuse element 5 melts.

FIG. 5 shows a condition in which the fuse element 5 is housed in the housing 6. In this condition (in which the fuse element 5 is housed in the housing 6), the flap 7 on the housing 6 is bent to close the above open portion. The flap 7 is retained by the pawls 4 formed respectively on the terminal portions 1 and 2 of the fuse element 5.

In the above conventional blade-type fuse, the flap 7, formed integrally with the housing 6, is bent to close the open lower end portion of the housing 6 so as to hold or retain the molten metal within the housing 6 when the fusible body 3 melts.

However, the flap 7 is held in contact with the pawls 4 formed on the terminal portions 1 and 2 of the fuse element 5, and therefore the flap-retaining pawls 4 are heated when electric current flows through the fuse element 5, so that the resin-molded flap 7 may be melted by this heat. If the flap 7 melts, the closed open portion is made open, so that the molten metal may dissipate to the exterior when the fusible body 3 melts. And besides, since the flap 7 is molded, it exhibits a low resistance to a bending stress, and therefore the flap 7, when bent so as to close the open portion of the housing 6, may be damaged.

The melting of the fusible body 3 can be confirmed by viewing the fuse element 5 through the upper end of the transparent housing 6. However, numerals or the like, indicating the capacity of the fuse, are marked on the upper end of the housing 6, and therefore it is difficult to view the fuse element within the housing with the eyes. Further, kinds of housings 6 are distinguished by colors, and therefore if the transmittance of the housing 6 is low, it is difficult to view the fuse element within the housing with the eyes.

SUMMARY OF THE INVENTION

With the above problems in view, it is an object of the invention to provide a fuse in which molten metal can be positively held or retained in a housing when an element melts, and the melting of the element can be easily confirmed.

The above object of the invention has been achieved by a fuse including a fuse element including opposite side portions respectively defining a pair of metal terminals which are connected together through an element having a fusible portion, and are disposed in a generally common plane, and a flap of a metal material which is bendable at the boundary between the flap and the element, an insulating member being formed on at least one face of the flap; and a housing including opposite side portions respectively defining a pair of terminal receiving portions for respectively receiving the pair of terminals in such a manner that distal end portions of said terminals project outwardly from the terminal receiving portions, respectively, and a central portion defining an element receiving portion for receiving the element, the element receiving portion having an open portion at its upper side, in which when the flap is bent, that face of the flap having the insulating member formed thereon is exposed to the exterior.

Preferably, the fuse portion has an arcuate shape.

In the above construction, the fuse element is inserted into the housing from the upper side, and is housed therein. Then, the flap is over the open portion of the housing by bending the flap. The flap having the insulating member formed thereon, is exposed to the exterior in order to prevent an electric shock.

When the fusible portion melts, the element is deformed by a stress accumulated in the fuse portion, so that the flap lifts.

In the case where the fusible portion is formed into an arcuate shape, the amount of the stress accumulated in the fuse portion can be increased, so that the flap lifts to a larger extent upon deformation of the element.

DETAILED DESCRIPTION OF THE PREFERRED EMBODIMENT

A preferred embodiment of the present invention will now be described with reference to the drawings.

Figure 1:
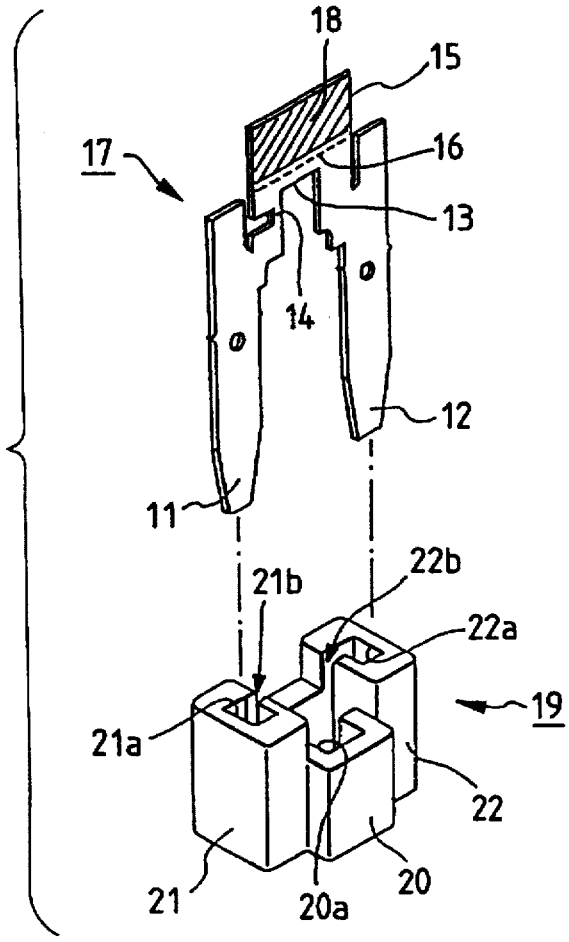
FIG. 1 is an exploded, perspective view of one preferred embodiment of a fuse of the present invention.

FIG. 1 shows one preferred embodiment of the present invention. More specifically, a pair of blade-shaped terminal portions 11 and 12 of an electrically-conductive material are integrally connected together through an element 13 of an inverted U-shape which is also made of an electrically-conductive material. A narrow fusible portion 14 is formed at one end portion of the element 13. The fusible portion 14 has a resistance that is higher than the other portion of the element 13, and therefore when excess current flows through this fuse element, the fusible portion 14 rises in temperature, and melts (that is, is severed by melting).

A flap 15 extends upwardly from the element 13. The flap 15 is formed integrally with the terminal portions 11 and 12 and the element 13 having the fusible portion 14. The terminal portions 11 and 12, the element 13 and the flap 15 are formed simultaneously by pressing.

The flap 15 is bent perpendicularly at the boundary between the element 13 and the flap 15 to close an open portion of a housing described later. The boundary is indicated by a broken line in the drawings.

Insulating member 18 is provided on the surface of the flap 15. Examples of this insulating member 18 includes an insulating film bonded to the surface of the flap 15, and an insulating coating applied to the surface of the flap 15. This insulating member 18 need only to be formed at least on that surface or side of the flap 15 which is directed outwardly when the flap 15 is bent so as to close the open portion of the housing.

The housing 19, which houses the above fuse element 17. The housing 19 includes three blocks connected together, and more specifically the housing 19 includes a central portion (or block) defining an element receiving portion 20 for receiving the element 13, and opposite side portions (or blocks) respectively defining a pair of terminal receiving portions 21 and 22 for receiving the terminal portions 11 and 12, respectively. The three receiving portions 20, 21 and 22 have their bottom surfaces disposed in a common plane, and the upper surface of the element receiving portion (central portion) 20 is lower than the upper surfaces of the terminal receiving portions 21 and 22. The housing 19 is so designed that when the fuse element 17 is housed therein, those portions (distal end portions) of the terminal portions 11 and 12 extending from a generally central portion thereof to their distal end are projected outwardly from the lower end of the housing 19.

Open portions 20*a*, 21*a* and 22*a* are formed respectively in the upper surfaces of the element receiving portion 20 and the terminal receiving portions 21 and 22, and the fuse element 17 is inserted into the housing 19 through these open portions 20*a*, 21*a* and 22*a* from the upper side. The open portion 20*a* of the element receiving portion 20 is generally equal to or slightly smaller than the flap 15 of the fuse element 17 so that the open portion 20*a* is under the flap 15. Slits 21*b* and 22*b* are formed respectively in the peripheral walls of the terminal receiving portions 21 and 22, and are open to the open portions 21*a* and 22*a*, respectively. The slits 21*b* and 22*b* guide the terminal portions 11 and 12, respectively, when inserting the fuse element 17 into the housing 19, and the slits 21*b* and 22*b* also serve to position the fuse element 17 upon insertion of the fuse element 17 into the housing 19.

Figure 2:
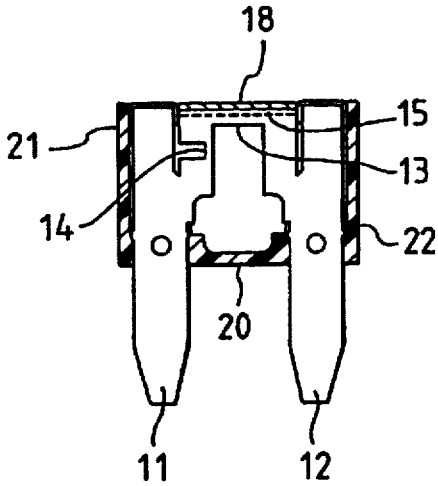
FIG. 2 is a cross-sectional view showing the fuse of FIG. 1.

FIG. 2 is a cross-sectional view showing a condition in which the fuse element 17 is inserted in the housing 19. As shown in FIG. 2, the terminal portions 11 and 12 are inserted respectively into the open portions 21*a* and 22*a* of the terminal receiving portions 21 and 22, and extend respectively through the terminal receiving portions 21 and 22, so that the lower (distal) end portions of the terminal portions 21 and 22 project outwardly from the lower ends of the terminal portions 21 and 22, respectively.

As shown in FIG. 2, the fusible portion 14 is received in the element receiving portion 20 of the housing 19, and in this condition the flap 15 is over the open portion 20*a* of the element receiving portion 20.

In this condition, the insulating member 18, formed on the upper surface of the flap 15, is directed upwardly, and even if a human body contacts the flap 15, he will not receive an electric shock, thus providing safety.

The operation of the flap 15 formed on the fuse element 17 will now be described.

When electric current flows through the fuse element 17, the fuse element 17 and particularly the element 13 are heated because of its internal resistance. However, since the flap 15 is formed on the element 13, the generated heat will not be accumulated in the element 13, but is radiated to the exterior through the flap 15. As a result, the temperature rise of the fuse element 17 is suppressed.

On the other hand, when electric current of a value more than a predetermined level flows through the fuse element 17, the temperature of the fusible portion 14 rises, so that the fusible portion 14 melts (that is, is severed by melting). When the fusible portion 14 thus melts, the molten metal dissipates within the element receiving portion 20 because of a stress produced during the melting. However, the open portion 20*a* of the element receiving portion 20 is under the flap 15 of the fuse element 17, and therefore the molten metal is held or retained within the element receiving portion 20.

Figure 3:
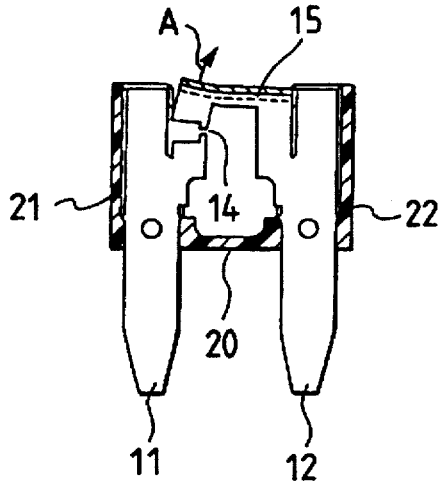
FIG. 3 is a cross-sectional view showing a condition in which a fuse element of FIG. 1 melts.
Figure 4:
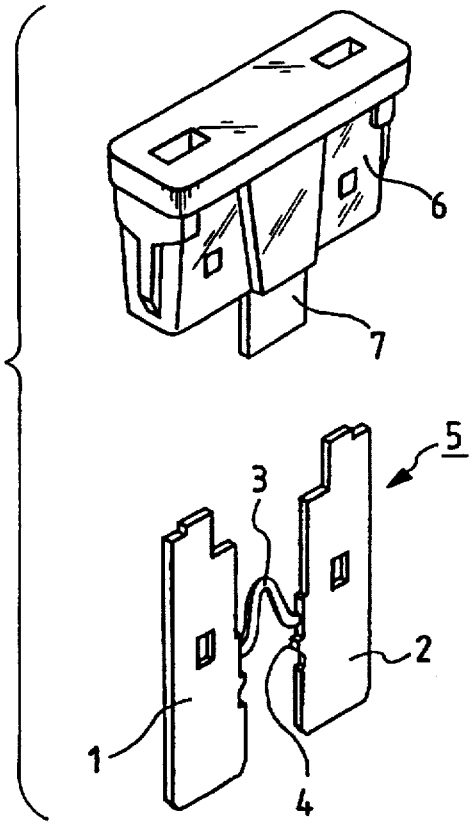
FIG. 4 PRIOR ART
FIG. 4 is an exploded, perspective view of a conventional fuse.
Figure 5:
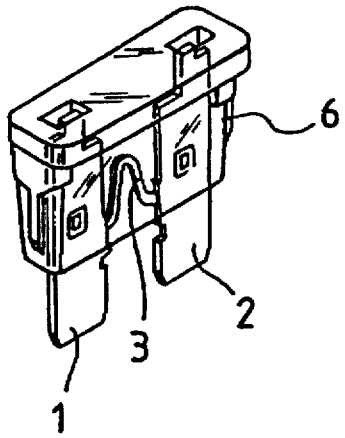
FIG. 5 PRIOR ART
FIG. 5 is a perspective view showing the conventional fuse.

The fusible portion 14, when melted, is severed by the stress, so that the element 13 is deformed as shown in FIG. 3. As a result, the flap 15 is lifted in a direction indicated by arrow A. By viewing the lifted flap 15 from the exterior, the melting of the fuse can be easily confirmed.

Figure 6:
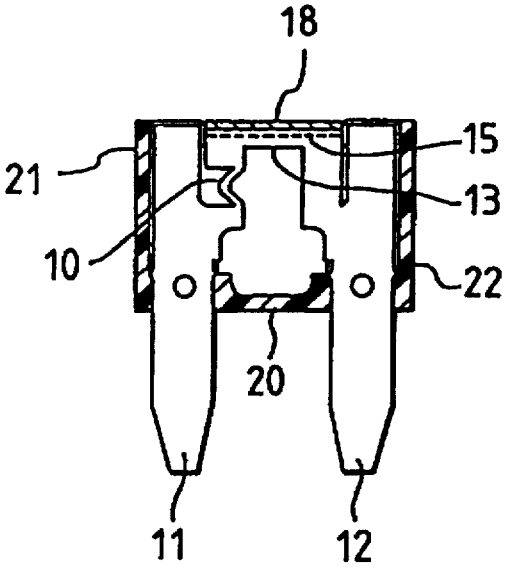
FIG. 6 is a cross-sectional view showing another example of a fuse of the present invention.

The degree of lift of the flap 15 depends on the stress accumulated in the fusible portion 14. Therefore, in order to increase the degree of lift of the flap 15, as shown in FIG. 6, the element 13 has a fusible portion 10 which is formed into an arcuate shape, instead of the fusible portion 14 which is straight, to increase the amount of the stress to be accumulated.

As described above in detail, in the present invention, the terminal portions of the fuse element are inserted into the housing through the respective open portions of the terminal receiving portions of the housing, and the flap, formed integrally with the terminal portions and the element having the fusible portion, is bent so that the flap is over the open portion of the element receiving portion, and the flap is so designed as to be deformed by a stress produced during the melting of the fusible portion, and therefore the molten metal is held or retained within the housing when the fusible portion melts, and therefore the molten metal will not dissipate to the exterior of the housing.

The flap integral with the element is made of a metal material, and therefore exhibits a high resistance to a bending stress. The flap radiates the heat, accumulated in the element, and therefore the housing, molded of a synthetic resin, in which the fuse element is housed, will not be melted by the heat.

The element is deformed during the melting of the fusible portion, so that the flap lifts, and therefore the melting of the fusible portion can be easily confirmed from the condition of the flap. Further, the melting of the fusible portion can be confirmed also by touching the lifted flap.

When the fusible portion of the element is formed into an arcuate shape, the stress of a larger amount is accumulated in the fusible portion, and therefore the flap lifts in a larger amount upon melting of the fusible portion.

What is claimed is:

1. A fuse, comprising:

a fuse element including: an element portion having a fusible portion; a pair of metal terminals connected together through said element portion, wherein said element portion and said metal terminals being formed in a substantially common plane; and a flap portion which is bendable at a boundary between said flap portion and said element, said flap portion having an insulating member provided on at least one face thereof; and a housing including: a pair of terminal receiving portions for respectively receiving said metal terminals so that distal end portions of said terminals project outwardly from said terminal receiving portions, respectively; and an element receiving portion for receiving said element portion, said element receiving portion having an upper opening at an upper side thereof, wherein when said flap is bent, the face of said flap having said insulating member provided thereon is exposed to the exterior.

2. The fuse of claim 1, wherein said upper opening of said element receiving portion is substantially equal to or slightly smaller than said flap.

3. The fuse of claim 1, wherein a central portion of said housing defines said element receiving portion, and opposite side portions of said housing defines said terminal receiving portions.

4. The fuse of claim 1, wherein an upper surface of said element receiving portion is lower than upper surfaces of said terminal receiving portions.

5. The fuse of claim 4, wherein when said flap is bent, said flap is over said upper opening of said element receiving portion.

6. The fuse of claim 1, wherein when a heat is generated by flowing a current through said fuse element, said flap radiates the generated heat to the exterior.

7. The fuse of claim 1, wherein when said fusible portion is melted, said flap prevents to dissipate the molten metal from said element receiving portion to the exterior.

8. The fuse of claim 1, wherein said flap is lifted by a deformation of said element portion by the stress when said fusible portion is melted.

9. The fuse of claim 1, wherein said fusible portion has an arcuate shape.

* * * * *